US010468781B1

(12) United States Patent
Paulsen et al.

(10) Patent No.: US 10,468,781 B1
(45) Date of Patent: Nov. 5, 2019

(54) POLARIZATION CONTROL FOR ELECTRONICALLY SCANNED ARRAYS

(71) Applicant: Rockwell Collins, Inc., Cedar Rapids, IA (US)

(72) Inventors: Lee M. Paulsen, Cedar Rapids, IA (US); Michael Charles Meholensky, Marion, IA (US)

(73) Assignee: ROCKWELL COLLINS, INC., Cedar Rapids, IA (US)

( * ) Notice: Subject to any disclaimer, the term of this patent is extended or adjusted under 35 U.S.C. 154(b) by 0 days.

(21) Appl. No.: 16/021,784

(22) Filed: Jun. 28, 2018

(51) Int. Cl.

| | |
|---|---|
| ***H01Q 21/06*** | (2006.01) |
| ***H01Q 3/26*** | (2006.01) |
| *H01Q 5/42* | (2015.01) |
| *H01Q 21/30* | (2006.01) |

(52) U.S. Cl.
CPC ..... *H01Q 21/061* (2013.01); *H01Q 3/26* (2013.01); *H01Q 5/42* (2015.01); *H01Q 21/30* (2013.01)

(58) Field of Classification Search
CPC ..... H01Q 21/061; H01Q 3/26; H01Q 5/42; H01Q 21/30
USPC ..... 343/725
See application file for complete search history.

(56) References Cited

U.S. PATENT DOCUMENTS

| | | | | |
|---|---|---|---|---|
| 10,224,644 | B1 * | 3/2019 | Park | H01Q 21/0075 |
| 10,224,645 | B2 * | 3/2019 | Rao | H01Q 1/246 |
| 10,297,918 | B2 * | 5/2019 | Zhang | H01Q 21/065 |
| 10,305,174 | B2 * | 5/2019 | Ryan | H01Q 1/273 |

* cited by examiner

*Primary Examiner* — Brian K Young
(74) *Attorney, Agent, or Firm* — Donna P. Suchy; Daniel M. Barbieri

(57) ABSTRACT

Systems and methods of controlling signal polarization are provided herein. An antenna array may include antenna elements each communicatively connected to a variable gain amplifier (VGA) with discrete amplitude control, and a phase shifter with discrete phase control, to provide discrete polarization states. A polarization controller may identify a target polarization state with a target amplitude and a target polarization angle. The polarization controller may identify a first polarization state and a second polarization state from the discrete polarization states, that are nearest in absolute amplitude to the target amplitude and nearest in polarization angle to the target polarization angle. The polarization controller may concurrently form a signal with the identified first polarization state using a first portion antenna elements, and a signal with the identified second polarization state using a second portion of antenna elements.

20 Claims, 12 Drawing Sheets

400

500

604

700

POLARIZATION CONTROL FOR ELECTRONICALLY SCANNED ARRAYS

BACKGROUND

Various radar applications may specify a particular polarization state, such as linear, circular, or elliptically polarizations for the communicated radiofrequency (RF) signals. For proper operation, such radar applications may reject cross-polarized RF signals for frequency reuse. Failure to reject cross-polarized RF signals may result in degradation of the signal-to-noise ratio and lead to noncompliance with system configurations.

SUMMARY

In one aspect, embodiments of the inventive concepts disclosed herein are directed to a method of controlling signal polarization. The method may include identifying a target polarization state for an antenna array. The target polarization state may include a target amplitude and a target polarization angle. The antenna array may include a plurality of antenna elements each communicatively connected to a variable gain amplifier (VGA) with discrete amplitude control, and a phase shifter with discrete phase control, to provide a plurality of discrete polarization states. The method may include identifying a first polarization state and a second polarization state from the plurality of discrete polarization states, that are nearest in absolute amplitude to the target amplitude, and nearest in polarization angle to the target polarization angle. The first polarization state may have a first polarization angle greater than the target polarization angle. The second polarization state may have a second polarization angle less than the target polarization angle. The method may include concurrently forming a signal with the identified first polarization state using a first portion of the plurality of antenna elements, and a signal with the identified second polarization state using a second portion of the plurality of antenna elements.

In some embodiments, and in accordance with the inventive concepts disclosed herein, the method may include performing a dot product of the target polarization state and the first polarization state to obtain a magnitude value. In some embodiments, the method may include obtaining a ratio of the magnitude value to the target amplitude. In some embodiments, the method may include determining the first portion of the plurality of antenna elements according to the ratio. In some embodiments, the method may include performing a dot product of the target polarization state and the second polarization state to obtain a magnitude value. In some embodiments, the method may include obtaining a ratio of the magnitude value to the target amplitude. In some embodiments, the method may include determining the second portion of the plurality of antenna elements according to the ratio.

In some embodiments, and in accordance with the inventive concepts disclosed herein, the method may include approximately providing the target polarization state by spatially adding the signal with the identified first polarization state, to the signal with the identified second polarization state. In some embodiments, the method may include selecting antenna elements for the first portion of the plurality of antenna elements, to be at least partly spatially interspersed with antenna elements for the second portion of the plurality of antenna elements. In some embodiments, the method may include randomly selecting antenna elements for the first portion of the plurality of antenna elements, and antenna elements for the second portion of the plurality of antenna elements. In some embodiments, the target polarization state, the first polarization state and the second polarization state may each be a linear polarization state. In some embodiments, the target polarization state, the first polarization state and the second polarization state may each be a circular or elliptical polarization state.

In a further aspect, embodiments of the inventive concepts disclosed herein are directed to a system for controlling signal polarization. The system may include an antenna array. The antenna array may include a plurality of antenna elements each communicatively connected to a variable gain amplifier (VGA) with discrete amplitude control, and a phase shifter with discrete phase control, to provide a plurality of discrete polarization states. The system may include a polarization controller. The polarization controller may identify a target polarization state for the antenna array. The target polarization state may include a target amplitude and a target polarization angle. The polarization controller may identify a first polarization state and a second polarization state from the plurality of discrete polarization states, that are nearest in absolute amplitude to the target amplitude, and nearest in polarization angle to the target polarization angle. The first polarization state may have a first polarization angle greater than the target polarization angle. The second polarization state may have a second polarization angle less than the target polarization angle. The polarization controller may concurrently form a signal with the identified first polarization state using a first portion of the plurality of antenna elements, and a signal with the identified second polarization state using a second portion of the plurality of antenna elements.

In some embodiments, and in accordance with the inventive concepts disclosed herein, the polarization controller may perform a dot product of the target polarization state and the first polarization state to obtain a magnitude value. In some embodiments, the polarization controller may obtain a ratio of the magnitude value to the target amplitude. In some embodiments, the polarization controller may determine the first portion of the plurality of antenna elements according to the ratio. In some embodiments, the polarization controller may perform a dot product of the target polarization state and the second polarization state to obtain a magnitude value. In some embodiments, the polarization controller may obtain a ratio of the magnitude value to the target amplitude. In some embodiments, the polarization controller may determine the second portion of the plurality of antenna elements according to the ratio.

In some embodiments, and in accordance with the inventive concepts disclosed herein, the polarization controller may approximately provide the target polarization state by spatially adding the signal with the identified first polarization state, to the signal with the identified second polarization state. In some embodiments, the polarization controller may select antenna elements for the first portion of the plurality of antenna elements, to be at least partly spatially interspersed with antenna elements for the second portion of the plurality of antenna elements. In some embodiments, the polarization controller may randomly select antenna elements for the first portion of the plurality of antenna elements, and antenna elements for the second portion of the plurality of antenna elements. In some embodiments, the target polarization state, the first polarization state and the second polarization state may each be a linear polarization state. In some embodiments, the target polarization state, the first polarization state and the second polarization state may each be a circular or elliptical polarization state.

BRIEF DESCRIPTION OF THE DRAWINGS

Implementations of the inventive concepts disclosed herein may be better understood when consideration is given to the following detailed description thereof. Such description makes reference to the included drawings, which are not necessarily to scale, and in which some features may be exaggerated and some features may be omitted or may be represented schematically in the interest of clarity. Like reference numerals in the drawings may represent and refer to the same or similar element, feature, or function. In the drawings.

DETAILED DESCRIPTION

Figure 1:
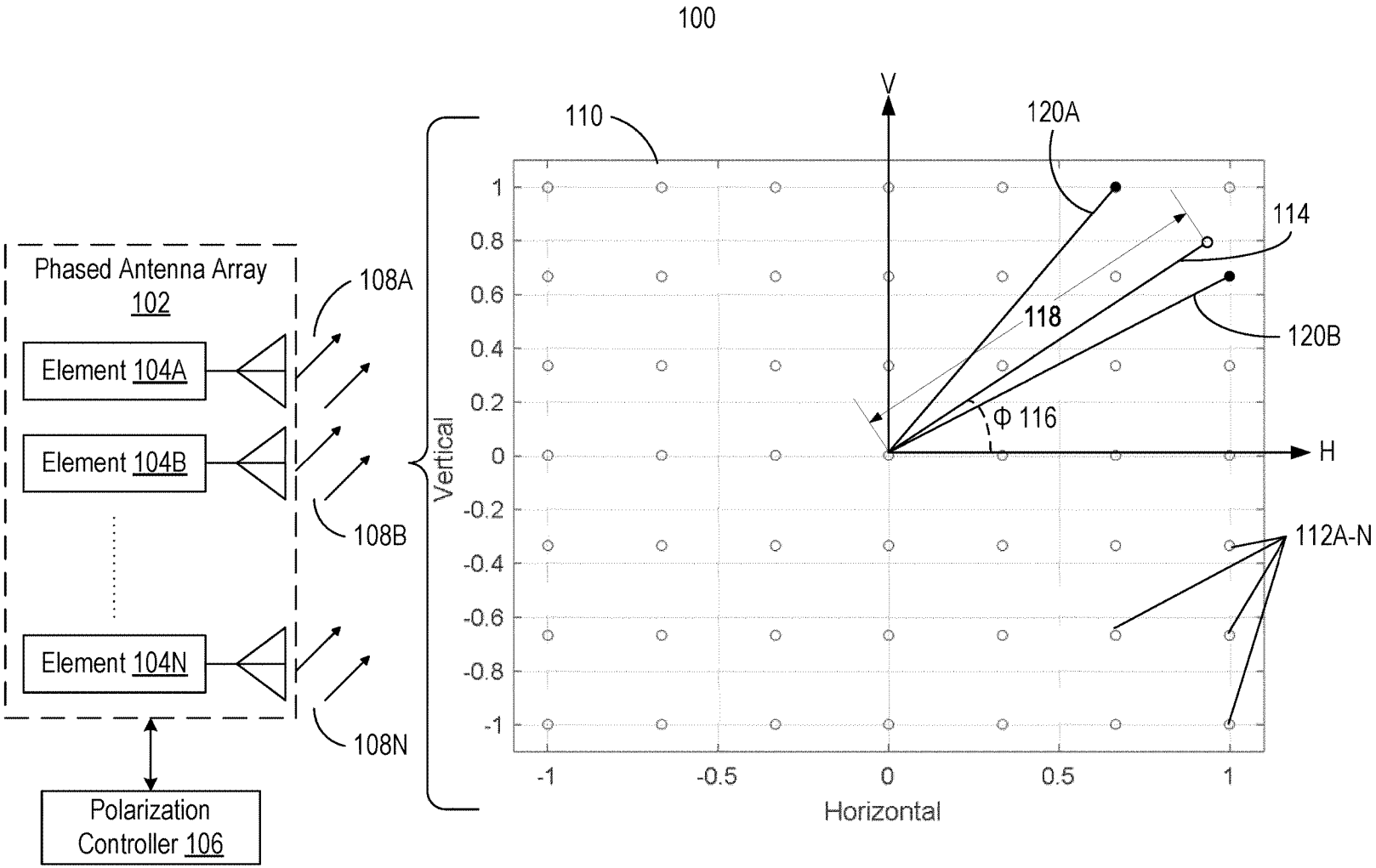
FIG. 1 is a block diagram of a system for controlling signal polarization, in accordance with some embodiments of the inventive concepts disclosed herein.

Before describing in detail embodiments of the inventive concepts disclosed herein, it should be observed that the inventive concepts disclosed herein include, but are not limited to a novel structural combination of components and circuits, and not to the particular detailed configurations thereof. Accordingly, the structure, methods, functions, control and arrangement of components and circuits have, for the most part, been illustrated in the drawings by readily understandable block representations and schematic diagrams, in order not to obscure the disclosure with structural details which will be readily apparent to those skilled in the art, having the benefit of the description herein. Further, the inventive concepts disclosed herein are not limited to the particular embodiments depicted in the schematic diagrams, but should be construed in accordance with the language in the claims.

For purposes of reading the description of the various embodiments below, the following descriptions of the sections of the specification and their respective contents may be helpful:

Section A describes polarization control for electronically scanned arrays.

Section B describes arbitrary polarization in beamforming for electronically scanned arrays.

Section C describes ultra-wide band active electronically scanned arrays for element-level synthesis.

A. Polarization Control for Electronically Scanned Arrays

In some aspects, embodiments of the inventive concepts disclosed herein are directed to a system, a method, a device, or an apparatus for controlling signal polarization. Radio applications, such as satellite communications, avionic communications, and cellular networks, may use radiofrequency (RF) signals of a specified polarization state to communicate. For example, $K_u$-band satellite data applications may specify two arbitrary linear polarizations (e.g., north-south or east-west polarization). In contrast, $K_u$-band satellite television applications may specify two circular polarizations. To maintain proper operation and communications for these radar applications, the cross-polarized RF signal (sometimes referred to as Xpol) is to be rejected due to frequency reuse. Failure to adequately reject the cross-polarized signal in receive mode may result in degradation of the signal-to-noise (SNR) of the received RF signals. In addition, failure to adequate reject the cross-polarized signal in transmit mode may lead to violation of operational standards for the radar application and may also be a violation of regulatory prerequisites or standards.

Polarization synthesis networks (PSN) in phased arrays (also referred to as electronically scanned arrays (ESAs)) may be used to generate RF signals with different polarizations. The PSNs may receive inputs from corresponding individual radiators with both vertical and horizontal polarizations. Using discrete variable gain amplifiers (VGAs) and phase shifters, the PSNs may each apply a complex weight (e.g., amplitude and phase offset) onto the vertical and horizontal polarization input from the corresponding radiator. The output of the vertical and horizontal polarizations may then be summed. Based on the sums, the phased array may form RF signals with the vertical and horizontal polarizations set applied with the complex weights. It may be, however, difficult to use phased arrays to achieve the specified polarization state for the radio application, relative to other types of radio arrays. For example, a 20 decibel (dB) cross-polarization signal rejection may entail 2° of phase control and 0.25 of amplitude control among the individual PSNs. The synthetization of polarization states may depend on a phase balance and an amplitude between the vertical and horizontal polarization inputs before summation. As such, the challenge in achieving the specified polarization state for the radio application may be exacerbated with the use of discrete VGAs, because the discrete VGAs may have a finite number of achievable polarization states. The quantization error due to the finite number of polarization states may result in a limit to the cross-polarization rejection achievable with the PSNs of the phased array. One technique to alleviate or reduce the quantization error may include using additional PSNs with more discrete VGAs and phase shifters to increase the number of achievable polarization states. This technique, however, may result in ever higher complexity in hardware components in the phased array and greater number of bits for the discrete VGAs in the PSNs to represent the achievable polarization states.

To address the technical challenges arising from PSNs and phased arrays, a polarization controller may take advantage of the averaging effect among the outputs of the PSNs across the phased array. The polarization controller may set the complex weights of the discrete VGAs and the phase shifters in individual PSNs to achieve the specified polarization state for the radio application with a target amplitude and a target phase. To that end, the polarization controller may set the variable gain and the phase offset of at least a first PSN (and corresponding antenna array element(s)) to a first polarization state, and may set the variable gain and the phase offset of at least a second PSNs (and corresponding antenna array element(s)) to a second polarization state. The first polarization state may have an amplitude closest to the target amplitude among the finite number of achievable polarization states for a phase greater than the target phase. The second polarization state may have an amplitude closest to the target amplitude among the finite number of achievable polarization states for a phase less than the target phase. More than two PSNs may be used to generate multiple polarization states about the target amplitude and phase. When combined, the polarization states may average out to the specified polarization state for the radio application. In this manner, the polarization controller in conjunction with the PSNs of the phased array may significantly reduce the amount of complexity of hardware components. With lower complexity of hardware components, the polarization controller may use lower number of bits for the discrete VGAs across the PSNs, as compared to the situation prior to reducing the complexity of the hardware components. All the while, the polarization controller may attain high accuracy with the specified polarization state for the radio application.

Referring now to FIG. 1, depicted is one embodiment of a system 100 for controlling signal polarization. The system 100 may include an a phased antenna array 102 with a set of elements 104A-N and a polarization controller 106. Each element 104A-N (which can include a polarization synthesis network) can include an antenna to generate and transmit a radiofrequency (RF) signal 108A-N. In generating each RF signal 108A-N, the polarization controller 106 may set a pair of complex weights for a pair of discrete variable gain amplifiers (VGAs) and phase shifters of the respective element 104A-N. The polarization controller 106 may apply the complex weights via the pair of discrete variable gain amplifiers (VGAs) and phase shifters of the respective element 104A-N to result in a polarization state of the RF signal 108A-N. The polarization state may be defined in a polarization plane 110. The polarization plane 110 may be decomposed into two orthogonal vectors, a vertical polarization axis (V) and a horizontal polarization axis (H). In each element 104A-N, a complex weight applied via one discrete VGA and phase shift may be used to form the polarization along the vertical polarization axis. In addition, another complex weight applied via the other discrete VGA and phase shift may be used to form the polarization along the horizontal axis.

As the polarization state of the RF signal 108A-N is set by the polarization controller 106 configuring the discrete VGAs and phase shifters of the respective element 104A-N, the polarization plane 110 may have a set of discrete polarization states 112A-N. Using the set of discrete polarization states 112A-N, the phase antenna array 102 may form a summed RF signal with a target polarization state 114 that has a target polarization angle (1) 116 and a target amplitude 118. The polarization controller 106 may set the pair of complex weights for the discrete VGAs and phase shifters of the first element 104A (for instance) to result in a first polarization state 120A. The first polarization state 120A may be one of the set of discrete polarization states 112A-N. The first polarization state 120A may have an amplitude closest to the target amplitude 118 of the target polarization state 114 with a polarization angle greater than the target polarization angle 116. The polarization controller 106 may set the pair of complex weights for the discrete VGAs and phase shifters of the second element 104B (for instance) to result in a second polarization state 120B. The second polarization state 120B may be one of the set of discrete polarization states 112A-N. The second polarization state 120B may have an amplitude closest to the target amplitude 118 of the target polarization state 114 with a polarization angle less than the target polarization angle 116. The summation of signals corresponding to the polarization states 120A and 120B set by the two example elements 104A and 104B (among other antenna elements 104 for example) may result in a signal with approximately the target polarization state 114. As the number of elements 104 transmitting in each of the polarization states 120A and 120B increases, the summation of their signals or transmissions can sometimes approximate closer to the target polarization state 114.

Figure 2:
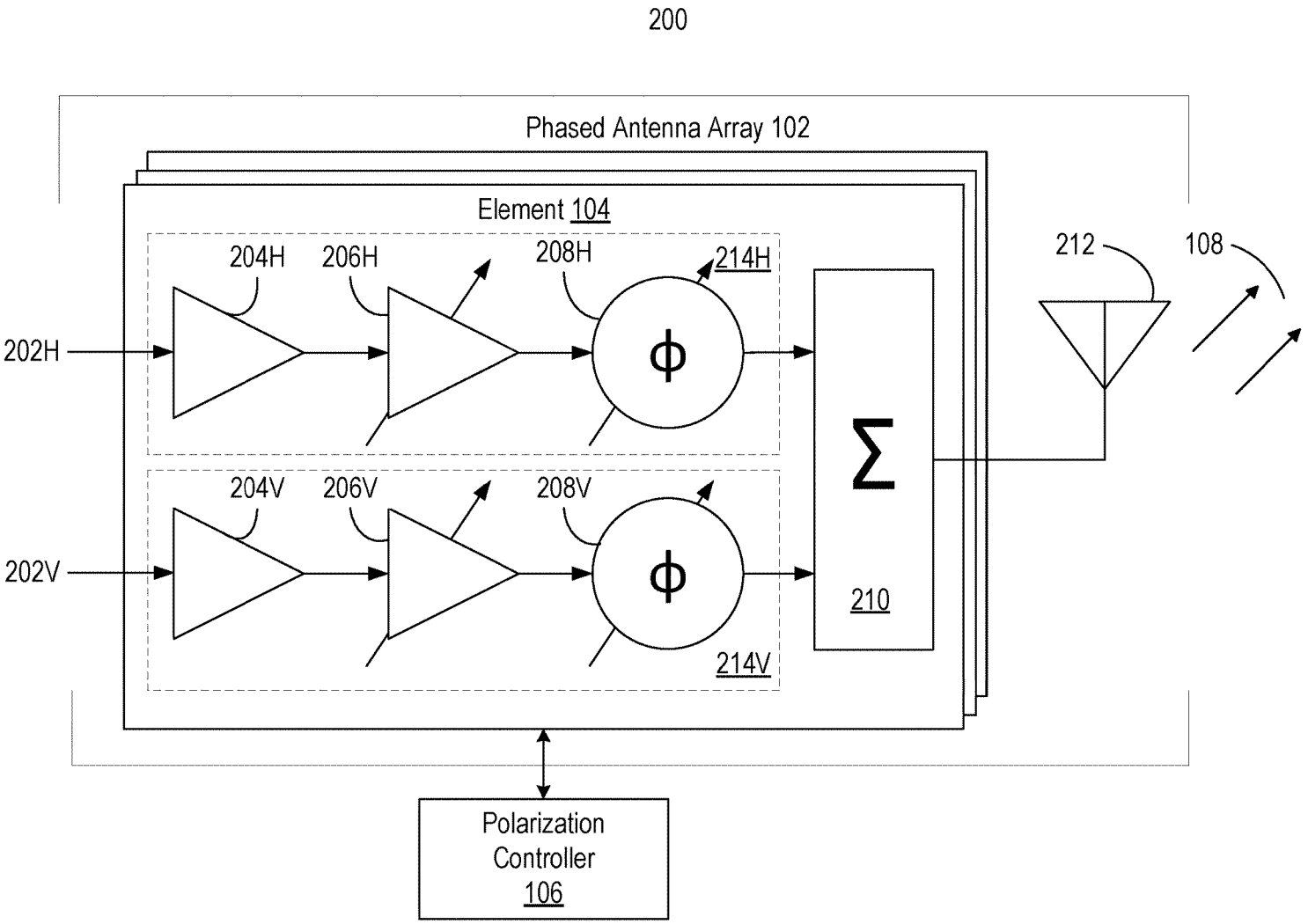
FIG. 2 shows a block diagram of a system architecture for controlling signal polarization, in accordance with some embodiments of the inventive concepts disclosed herein.

Referring now to FIG. 2, depicted is a block diagram of an embodiment of a system 200 for controlling signal polarization. The system 200 may include the polarization antenna 102 with the set of elements 104A-N (hereinafter generally referred to as element 104) and the polarization controller 106. The element 104 may include a horizontal port 202H, a vertical port 202V, a horizontal non-linear amplifier 204H, a vertical non-linear amplifier 204V, a horizontal variable-gain amplifier (VGA) 206H, a vertical digital VGA 206V, a horizontal digital phase shifter 208H, a vertical digital phase shifter 208V, a summation unit 210, and an antenna 212 to generate and transmit a signal 108A-N (generally referred to as signal 108). The vertical channel 202V, the horizontal non-linear amplifier 204H, and the horizontal digital VGA 206H may form a horizontal chain 214H of the element 104. The vertical channel 202V, the vertical non-linear amplifier 204V, the vertical digital phase shifter 208V may form a vertical channel 214V of the element 104. The polarization controller 106 may be communicatively coupled with each element 104 of the phased antenna array 102.

Each of the components listed above may include at least one processor. The processors may include a microprocessor unit, an application-specific integrated circuit (ASIC), and a field-programmable gate array (FPGA), among others. The processors may also be a multi-core processor or an array of processors. The memory in each above mentioned device or component may include electronic, optical, magnetic, or any other storage device capable of relaying or providing the processor with program instructions. The memory may include, for example, include a floppy disk, CD-ROM, DVD, magnetic disk, memory chip, Static random access memory (SRAM), Burst SRAM or SynchBurst SRAM (BSRAM), Dynamic random access memory (DRAM), Ferroelectric RAM (FRAM), NAND Flash, NOR Flash, and Solid State Drives (SSD), among others, or any combination thereof. The program instructions may include code from any programming language, such as C, C++, C#, Java, JavaScript, Perl, HTML, XML, Python, Visual Basic, et cetera, or any combination thereof.

In each element 104, the horizontal non-linear amplifier 204H may receive a projection of the signal on a horizontal plane (hereinafter referred to as a horizontal component) as an input via the horizontal port 202H. The vertical non-linear amplifier 204V may receive a projection of the signal on a vertical plane (hereinafter referred to as the vertical component) as an input via the vertical port 202V. The horizontal component may have an initial amplitude and an initial phase along the horizontal axis (H) defined by the polarization plane 110. In some embodiments, the horizontal component may be an analog signal. In some embodiments, the horizontal component may include a digital signal (e.g., a pulse amplitude modulated signal). The vertical component may have an initial amplitude and an initial phase along the vertical axis (V) defined by the polarization plane 110. In some embodiments, the vertical component may be an analog signal. In some embodiments, the vertical component may include a digital signal (e.g., a pulse amplitude modulated signal).

The horizontal non-linear amplifier 204H may be a low-noise amplifier, and may increase or decrease an amplitude of the incoming horizontal component, and can be used to remove distortions (e.g., harmonic or intermodulation) from the incoming horizontal component. The output of the horizontal non-linear amplifier 204H may be provided to the horizontal digital VGA 206H. The vertical non-linear amplifier 204V may be a low-noise amplifier, and may increase or decrease an amplitude of the incoming vertical component, and can be used to remove distortions (e.g., harmonic or intermodulation) from the incoming vertical component. The output of the vertical non-linear amplifier 204V may be provided to the vertical digital VGA 206V.

The horizontal digital VGA 206H may be a translinear amplifier or an exponential amplifier, and may include an analog-to-digital converter (ADC) to convert the horizontal component from an analog signal to a digital signal. The horizontal digital VGA 206H may have discrete amplitude control to increase or decrease the amplitude of the horizontal component to one of a set of quantized amplitudes as configured by the polarization controller 106. Each quantized amplitude may be at a defined interval (e.g., 0.10 dB, 0.25 dB, and 0.5 dB) from another quantized amplitude. The output of the horizontal digital VGA 206H may be provided to the horizontal digital phase shifter 208H. The vertical digital VGA 206V may be a translinear amplifier or an exponential amplifier, and may include an analog-to-digital converter (ADC) to convert the vertical component from an analog signal to a digital signal. The vertical digital VGA 206V may have discrete amplitude control to increase or decrease the amplitude of the vertical component to one of a set of quantized amplitudes as configured by the polarization controller 106. Each quantized amplitude may be at a defined interval (e.g., 0.10 dB, 0.25 dB, and 0.5 dB) from another quantized amplitude. The output of the vertical digital VGA 206V may be provided to the vertical digital phase shifter 208V.

The horizontal digital phase shifter 208H may be a switched-line phase shifter, a loaded-line phase shifter, a reflection line phase shifter, a quadrature phase shifter, among others. The horizontal digital phase shifter 208H may have discrete phase control to increase or decrease a phase of the horizontal component to one of a set of quantized phases as configured by the polarization controller 106. Each quantized phase may be at defined interval (e.g., 5°, 22.5°, and) 45° from another quantized phase. The output of the horizontal digital phase shifter 208H may be provided to the summation unit 210. The vertical digital phase shifter 208V may be a switched-line phase shifter, a loaded-line phase shifter, a reflection line phase shifter, a quadrature phase shifter, among others. The vertical digital phase shifter 208V may have discrete phase control to increase or decrease a phase of the vertical component to one of a set of quantized phases as configured by the polarization controller 106. Each quantized phase may be at defined interval (e.g., 5°, 22.5°, and 45°) from another quantized phase. The output of the vertical digital phase shifter 208V may be provided to the summation unit 210.

The summation unit 210 may receive the output from the horizontal chain 214H and the vertical chain 214V. The summation unit 210 may perform a summation of the outputs to generate a resultant signal 108 to transmit via the antenna 212 of the respective element 104. The resultant signal 108 may have an amplitude dependent on the amplitude of the horizontal component from the horizontal channel 214H and the amplitude of the vertical component from the vertical channel 214V. The resultant signal 108 may also have a phase dependent on the phase of the horizontal component from the horizontal channel 214H and the phase of the vertical component from the vertical channel 214V. The resultant signal 108 may also have a polarization state dependent on the amplitudes of the horizontal component and the vertical component, and the phases of the horizontal component and the vertical component configured by the polarization controller 106. In some embodiments, the polarization state of the resultant signal may include a linear polarization state, a circular polarization state, or an elliptical polarization state. For example, the complex weights specified by the polarization controller 106 of "1" for the amplitude of the horizontal component and "0" for the amplitude of the vertical component with in-phase 45° degree shift may result in the linear polarization state for the resultant signal 108. On the other hand, and by way of illustration, the complex weights specified by the polarization controller 106 of "1" for the amplitude of the horizontal component and "1" for the amplitude of the vertical component with quadrature phase shift may result in a circular polarization state for the resultant signal 108.

Because both the digital VGAs 206H and 206V and the digital phase shifters 208H and 208V have discrete control, the number of possible polarization states 112A-N generated by a single element 104 may be finite. In addition, each polarization state 112A-N generated by the element 104 may be at a defined spacing from one another (e.g., as depicted in the polarization plane 110 of FIG. 1). As such, the target polarization state 114 may not correspond to any one particular possible polarization state 112A-N. To attain the target polarization state 114 using the elements 104 of the phased antenna array 102, the polarization controller 106 may configure the digital VGAs 206H and 206V and the digital phase shifters 208H and 208V. Details of the functionalities of the polarization controller 106 in relation to the various components of the elements 104 of the phased antenna array 102 are explained herein below.

The polarization controller 106 may receive, select, or otherwise identify the target polarization state 114 for the phased antenna array 102. The target polarization state 114 may have a target polarization angle 116 and a target amplitude 118. The target amplitude 118 may be decomposed into, or represented by a horizontal amplitude on the horizontal axis (H) and a vertical amplitude on the vertical axis (V) of the polarization plane 110, for instance. The target polarization angle 116 may be defined relative to the horizontal axis (H) or the vertical axis (V) of the polarization plane 110, or relative to any other axes. The target polarization state 114 may be a linear polarization state, a circular polarization state, or an elliptical polarization state.

In some embodiments, the polarization controller 106 may select the target polarization state 114 based on a specified radio communication application for instance. The target polarization state 114 may be specified by the radio communication application. For example, $K_u$-band satellite data applications may specify two arbitrary linear polarizations (e.g., north-south or east-west polarization). In contrast, $K_u$-band satellite television applications may specify two circular polarizations. In some embodiments, the polarization controller 106 may receive the target polarization state 114 via a user interface (e.g., via user input). For example, a system administrator may use a graphical user interface and peripheral devices (e.g., keyboard) to enter the target polarization angle 116 and the target amplitude 118 for the target polarization state 114.

The polarization controller 106 may determine, select, or otherwise identify a subset of polarization states 120A-N from the set of discrete polarization states 112A-N, for use in generating, forming or approximating the target polarization state 114 with the phased antenna array 102. As explained above, the set of discrete polarization states 112A-N may be the polarization states achievable by the elements 104 of the phased antenna array 102 due to the discrete control by the digital VGAs 206H and 206V and discrete phase shifters 208H and 208V. The subset of polarization states 120A-N may include at least two of the discrete polarization states 112A-N. Each polarization state 120A-N may be a linear polarization state, a circular polarization state, or an elliptical polarization state. In some embodiments, the polarization controller 106 may identify the subset of polarization states 120A-N closest in amplitude and phase to the target polarization state 114 from the set of discrete polarization states 112A-N. In some embodiments, the polarization controller 106 may determine or identify the absolute amplitude of the target polarization state 114. The absolute amplitude may correspond to a non-negative value of the target amplitude 118. In some embodiments, the polarization controller 106 may determine or identify the absolute amplitude of each discrete polarization state 112A-N. The absolute amplitude may correspond to a non-negative value of the amplitude of the discrete polarization state 112A-N.

To identify the subset of discrete polarization states 112A-N, the polarization controller 106 may compare the target amplitude 118 (or the absolute amplitude) to the amplitudes of the set of discrete polarization states 112A-N. In performing the comparing, the polarization controller 106 may calculate or determine a difference between the target amplitude 118 and the amplitude of the discrete polarization state 112A-N for each of at least some of the discrete polarization states 112A-N. Based on the comparison, the polarization controller 106 may identify a subset of the discrete polarization states 112A-N closest in amplitude to the target amplitude 118 of the target polarization state 114. In some embodiments, the polarization controller 106 may apply a nearest neighbor search (NNS) to identify the subset of discrete of discrete polarization states 112A-N. In some embodiments, the polarization controller 106 may select or identify the subset of the discrete polarization states 112A-N with the lowest n differences between the amplitude of the discrete polarization state 112A-N and the target amplitude 118 ($n \geq 2$).

The polarization controller 108 may identify a number of discrete polarization states 112A-N with polarization angles closest to the target polarization angle 116. For instance, with the identification of the subset of discrete polarization states 112A-N with amplitudes closest to the target amplitude 118, the polarization controller 108 may identify another subset of discrete polarization states 112A-N with polarization angles closest to the target polarization angle 116. The discrete polarization states 112A-N with polarization angles closest to the target polarization angle 116 may be selected or identified from the subset of discrete polarization states 112A-N with amplitudes closest to the target amplitude 118. In some embodiments, the polarization controller 106 may determine or identify the target polarization angle 116 of the target polarization state 114. In some embodiments, the polarization controller 106 may identify polarization angles of each of the subset of the discrete polarization states 112A-N with amplitudes closest to the target amplitude 118. For each discrete polarization state 112A-N (e.g., of the discrete polarization states 112A-N, or of the subset of the discrete polarization states 112A-N with amplitudes closest to the target amplitude 118), the polarization controller 106 may compare the polarization angle with the target polarization angle 116. In some embodiments, the polarization controller 106 may calculate or determine a difference between the polarization angle for the discrete polarization state 112A-N and the polarization angle 116. Based on the comparison, the polarization controller 106 may identify the subset of the discrete polarization states 112A-N with polarization angles closest to the target polarization angle 116 of the target polarization state 114. In some embodiments, the polarization controller 106 may apply a nearest neighbor search (NNS) to identify the subset of discrete of discrete polarization states 112A-N. In some embodiments, the polarization controller 106 may select or identify the subset of the discrete polarization states 112A-N with the lowest n differences between the polarization angle of the discrete polarization state 112A-N and the target polarization angle 116 ($n \geq 2$).

From discrete polarization states 112A-N with amplitudes closest to the target amplitude 118 and polarization angles closest to the target polarization angle 116 (e.g., selected or identified as described above, or otherwise), the polarization controller 106 may identify a subset of polarization states 120A-N to generate, synthesize, implement, form or produce the target polarization state 114, using the phased antenna array 102. In some embodiments, the polarization controller 108 may select or identify a first subset from the identified discrete polarization states 112A-N with polarization angles greater than the target polarization angle 116. The first subset may include one or more of the discrete polarization states 112A-N with polarization angles greater than the target polarization angle 116. For example, the polarization controller 108 may identify the first polarization state 120A from the set of discrete polarization states 112A-N. The first polarization state 120A may have an amplitude closest to the target amplitude 118 with a polarization angle greater than the target polarization angle 116. In some embodiments, the polarization controller 108 may select or identify a second subset from the identified discrete polarization states 112A-N with polarization angles less than the target polarization angle 116. The first subset may include one or more of the discrete polarization states 112A-N with polarization angles less than the target polarization angle 116. For example, the polarization controller 108 may identify the second polarization state 120B from the set of discrete polarization states 112A-N. The second polarization state 120B may have an amplitude closest to the target amplitude 118 with a polarization angle less than the target polarization angle 116.

In certain embodiments, the polarization controller 106 may determine a set of average polarization states using the subset of discrete polarization states 112A-N with amplitudes closest to the target amplitude 118 and polarization angles closest to the target polarization angle 116. The average polarization state may approximate the target polarization state 114 in the target polarization angle 116 and the target amplitude 118. In some embodiments, the polarization controller 106 may select or identify one or more combinations of polarization states from the subset of discrete polarization states 112A-N. Each combination may include at least two polarization states 120A-N from the subset of identified discrete polarization states 112A-N. For each combination, the polarization controller 106 may calculate or determine the average polarization state by spatially adding and averaging the selected discrete polarization states 112A-N. The average polarization state may have an average amplitude and an average polarization angle determined based on the amplitudes and the polarization angles of the selected or combined polarization states 120A-N. It should be noted that the average amplitude and/or the average polarization angle may be offset from the amplitude and/or polarization states of the discrete polarization states 112A-N. For each combination, the polarization controller 106 may compare the average polarization state and the target polarization state 114. In some embodiments, the polarization controller 106 may calculate or determine a difference in spatial position in the polarization plane 110 between the average polarization state and the target polarization state 114. Based on the comparison, the polarization controller 106 may identify or select the average polarization state closest in approximation to the target polarization state 114. In some embodiments, the polarization controller 106 may select or identify the average polarization state with the lowest difference from the target polarization state 114 in the polarization plane 110. The polarization controller 106 may identify the constituent discrete polarization angles 120A-N for the combination corresponding to the average polarization state identified as nearest in approximation to the target polarization state 114, and may select this combination of polarization states to achieve or approximate the target polarization state 114.

From the phased antenna array 102, the polarization controller 106 may select subsets of elements 104 to generate the one or more signals 108 with the selected polarization states 120A-N to provide the target polarization state 114. The resultant signal 108 may provide a polarization state equal or approximate to the target polarization state 114 in the target polarization angle 116 and the target amplitude 118. In some embodiments, the selection of the elements 104 may be in accordance to the following formula:

$$\frac{|P_{Goal} \cdot P_1|}{|P_{Goal}|} = \%\text{ of } P_1 \text{ elements}$$

$$\frac{|P_{Goal} \cdot P_2|}{|P_{Goal}|} = \%\text{ of } P_2 \text{ elements}$$

where $P_{Goal}$ denotes the target polarization state 114, $P_1$ denotes the selected polarization state 120A-N with polarization angles greater than the target polarization angle 116, $P_2$ denotes the selected polarization state 120A-N with polarization angle less than the target polarization angle, % of $P_1$ elements refers to the percentage of elements 104 for generating the polarization state 120A or $P_1$, and $P_2$ elements refers to the percentage of elements 104 for generating the polarization state 120B or $P_2$.

To select the subsets of elements 104, the polarization controller 106 may calculate, determine, or perform a dot product of the target polarization state 114 and each polarization state 120A-N to obtain a magnitude value. The dot product (also referred to as a scalar product) may correspond to a magnitude of a scalar projection of the polarization state 120A-N onto the target polarization state 114. In some embodiments, the polarization controller 106 may calculate or determine an absolute value of the dot product. The polarization controller 106 may determine, calculate, or otherwise obtain a ratio of the magnitude value for each polarization state 120A-N to the target amplitude 118. In accordance with the ratios between the magnitude value for each polarization state 120A-N and the target amplitude 118, the polarization controller 106 may determine a percentage or a subset number of elements 104 from the phased antenna array 102 for the polarization state 120A-N. Each subset number of elements 104 may correspond to the polarization state 120A-N. In some embodiments, the polarization controller 106 may determine a first subset number of elements 104 for providing the resultant signal 108 with the polarization state 120A based on the ratio. The polarization controller 106 may also determine a second subset number of elements 104 exclusive from (or non-overlapping with) the first subset for providing the resultant signal 108 with the polarization state 120B based on the ratio.

With the determination of the subset numbers of elements 104, the polarization controller 106 may select the subsets of elements 104 to generate and provide the resultant signals 108 with the selected polarization states 120A-N. The polarization controller 106 may identify the subset number of elements 104 for each polarization state 120A-N. In some embodiments, the polarization controller 106 may select subsets of elements 104 for the selected polarization states 120A-N to be partly spatially interspersed or interleaved based on the number of elements 104. In some embodiments, the polarization controller 106 may select a first subset of elements 104 for the first polarization state 120A and a second subset of elements 104 for the second polarization state 120B based on the number for each polarization state 120A and 120B. The first subset and the second subset of elements 104 may be interleaved or interspersed, with the first subset of elements 104 to provide a signal 108A with the first polarization state 120A, and with the second subset of elements 104 to provide a signal 108B with second polarization state 120B. In some embodiments, the polarization controller 106 may randomly select elements to form the two subsets of elements 104 to provide the signals 108 with the polarization states 120A and 102B, based on the determined number of elements for each polarization state 120A, 102B. In some embodiments, the polarization controller 106 may select a first subset of elements 104 for the first polarization state 120A and a second subset of elements 104 for the second polarization state 120B based on the number of elements determined for each polarization state 120A, 120B. The first subset and the second subset of elements 104 may be randomly selected or partitioned from available elements in the phased antenna array 102.

The polarization controller 106 may concurrently form the signals 108A, 108B via the antennae 212 of the subsets of elements 104. The resultant signal 108 may provide the average polarization state closest in approximation to the target polarization state 114. For each selected (or component) polarization state 120A, 120B, the polarization controller 106 may concurrently form the signals 108A, 108B with the polarization state 120A, 120B using the antennae 212 of the corresponding subset of elements 104. Signals (e.g., 108A, 108B) formed with various polarization states (e.g., 120A, 120B) may be considered to be concurrently formed when formed within 1 second, or up to 1 minute of one another, for instance. In some embodiments, the polarization controller 106 may concurrently form a first signal 108A with the polarization state 120A using the antennae 212 of first subset of elements 104, and form a second signal 108B with the polarization state 120B using the antennae 212 of the second subset of elements 104.

In forming the resultant signals 108, the polarization controller 106 may configure the digital VGAs 206H and 206V and the digital phase shifters 208H and 208V of each element 104. In accordance with the selection of the subsets of the elements 104, the polarization controller 106 may set the complex weights to apply via the digital VGAs 206H and 206V and the digital phase shifters 208H and 208V in each element 104. For each element 104, the polarization controller 106 may identify which of the polarization states 120A-N the element 104 is to produce or generate based on the selection. With the identification of the polarization state 120A, 120B, the polarization controller 106 may identify the amplitude and the polarization angle of the polarization state 120A-N (e.g., to configure each corresponding element 104). In some embodiments, the polarization controller 106 may calculate, determine, or identify a horizontal component and a vertical component of the amplitude of the polarization state 120A-N. In some embodiments, the polarization controller 106 may calculate or determine, or identify the polarization angle of the polarization state 120A-N. The polarization angle may be relative to the vertical axis (V) and/or the horizontal axis (H) on the polarization plane 110 for example.

Using the amplitude and the polarization angle of the polarization state 120A-N, the polarization controller 106 may determine or set the complex weights for the digital VGAs 206H and 206V and the digital phase shifters 208H and 208V. The complex weight may include an amplitude and phase for each of the horizontal axis (H) and the vertical axis (V). In some embodiments, the polarization controller 106 may set the complex weights using a binary signal to provide or relay to each element 104 of the phased antenna array 102. The binary signal may include a sequence of bits representing the complex weights to be applied at the digital VGAs 206H and 206V and the digital phase shifters 208H and 208V. In some embodiments, the polarization controller 106 may set the amplitude of the complex weight for the horizontal axis (H) for the horizontal VGA 206H based on the horizontal component of the amplitude of the polarization state 120A-N. In some embodiments, the polarization controller 106 may set the phase of the complex weight relative the horizontal axis (H) for the horizontal digital phase shifter 208H based on the phase of the polarization state 120A-N. In some embodiments, the polarization controller 106 may set the amplitude of the complex weight for the vertical axis (H) for the vertical VGA 206V based on the vertical component of the amplitude of the polarization state 120A-N. In some embodiments, the polarization controller 106 may set the phase of the complex weight relative the vertical axis (V) for the vertical digital phase shifter 208V based on the phase of the polarization state 120A-N. In this manner, when the output signal of the horizontal chain 214H and the vertical chain 214V are provided to the summation unit 210, the antenna 212 of the element 104 may generate the signal 108 with the polarization state 120A-N. The polarization states 120A-N (e.g., 120A, 120B) of the signals 108 generated across the elements 104 of the phase antenna array 102 may average out to an approximation of the target polarization state 114.

Figure 3:
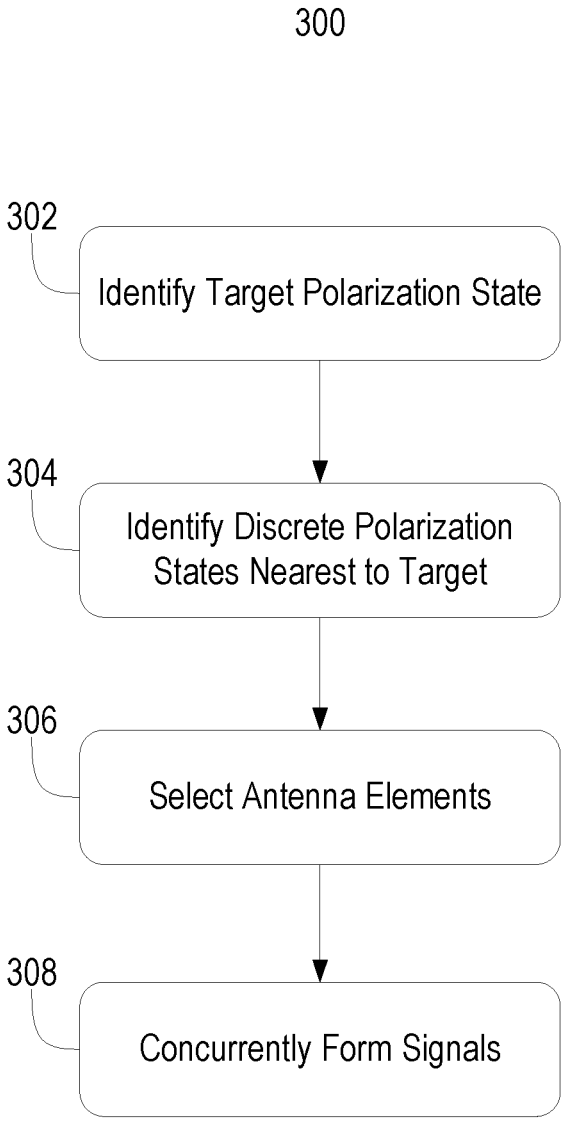
FIG. 3 shows a flow diagram of a method of controlling signal polarization, in accordance with some embodiments of the inventive concepts disclosed herein.

Referring now to FIG. 3, depicted is a flow diagram of method 300 of controlling signal polarization. The method 300 may be performed or implemented using any of the above mentioned components or devices of FIGS. 1 and 2, such as the polarization controller 106. In brief overview, a polarization controller may identify a target polarization state (302). The polarization controller may identify discrete polarization states nearest to the target polarization state (304). The polarization controller may select antenna elements (306). The polarization controller may concurrently form signals (308).

In further detail, a polarization controller may identify a target polarization state (302). The polarization controller may select or identify the target polarization state based on a specified radio communication application. Various radio communication applications may specify different target polarization states, such as linearly polarized, circularly polarized, or elliptically polarized. The target polarization state (e.g., corresponding to a given time instance) specified by the radio communication application may include a target amplitude and a target polarization angle (e.g., corresponding to the given time instance).

The polarization controller may identify discrete polarization states nearest to the target polarization state (304). The discrete polarization states may be those polarization states achievable using a phased antenna array with discrete control over amplitude and polarization angle. The polarization controller may identify a subset of the discrete polarization states with amplitudes and polarization angles closest to the target amplitude and the target polarization angle of the target polarization state. Out of the identified discrete polarization states for instance, the polarization controller may select at least one discrete polarization state with a polarization angle less than the target polarization angle. The polarization controller may also identify at least one discrete polarization state with a polarization angle greater than the target polarization angle.

The polarization controller may select antenna elements (306). The polarization controller may determine a number of subset antenna elements to provide each identified discrete polarization state of the subset. For each discrete polarization state, the polarization controller may calculate a dot product of the target polarization state and the discrete polarization state to obtain a magnitude value. The polarization controller may calculate a ratio of the magnitude value for the discrete polarization state and the target amplitude of the target polarization state. Using the radio, the polarization controller may determine number of subset antenna elements to provide each of the identified discrete polarization states. The polarization controller may select the antenna elements to provide the signal with the discrete polarization state based on the number. The antenna elements may be interspersed or randomly arranged.

The polarization controller may concurrently form signals (308). Based on the selection of antenna elements, the polarization controller may concurrently form the signals for each of the discrete polarization states to provide an polarization state approximate to the target. The polarization controller may set the complex weights to apply via horizontal and vertical digital VGAs and digital phase shifter of each antenna element. The setting of the complex weights may be based on the amplitude and the polarization angle of the discrete polarization state to be provided by the antenna element.

B. Arbitrary Polarization in Beamforming for Electronically Scanned Arrays

Antenna elements of an array may be configured to transmit or receive with a given polarization, such as linear polarization (vertical, horizontal, or some combination) and elliptical polarization, including right hand and left hand circular (RHC, LHC). Scenarios may exist where transmit polarization at the receiver is unknown. For example, polarization can change with relative platform orientation or signal reflection, or polarization may be unknown when searching for signals not yet identified. In addition, there may be cases in which a receiver has no control or limited control of antenna polarization. For example, polarization may be fixed, or may be limited to one polarization at a time. Furthermore, it may be that polarization is used for isolation from signals at some other polarization and ability to adjust polarization can improve signal strength and isolation from interference. There may be advantages if a beamforming transceiver operates with arbitrary polarization. This may apply to transmit as well as receive. Given multi-beam capability, independent control of polarization per beam may be desirable.

Figure 4:
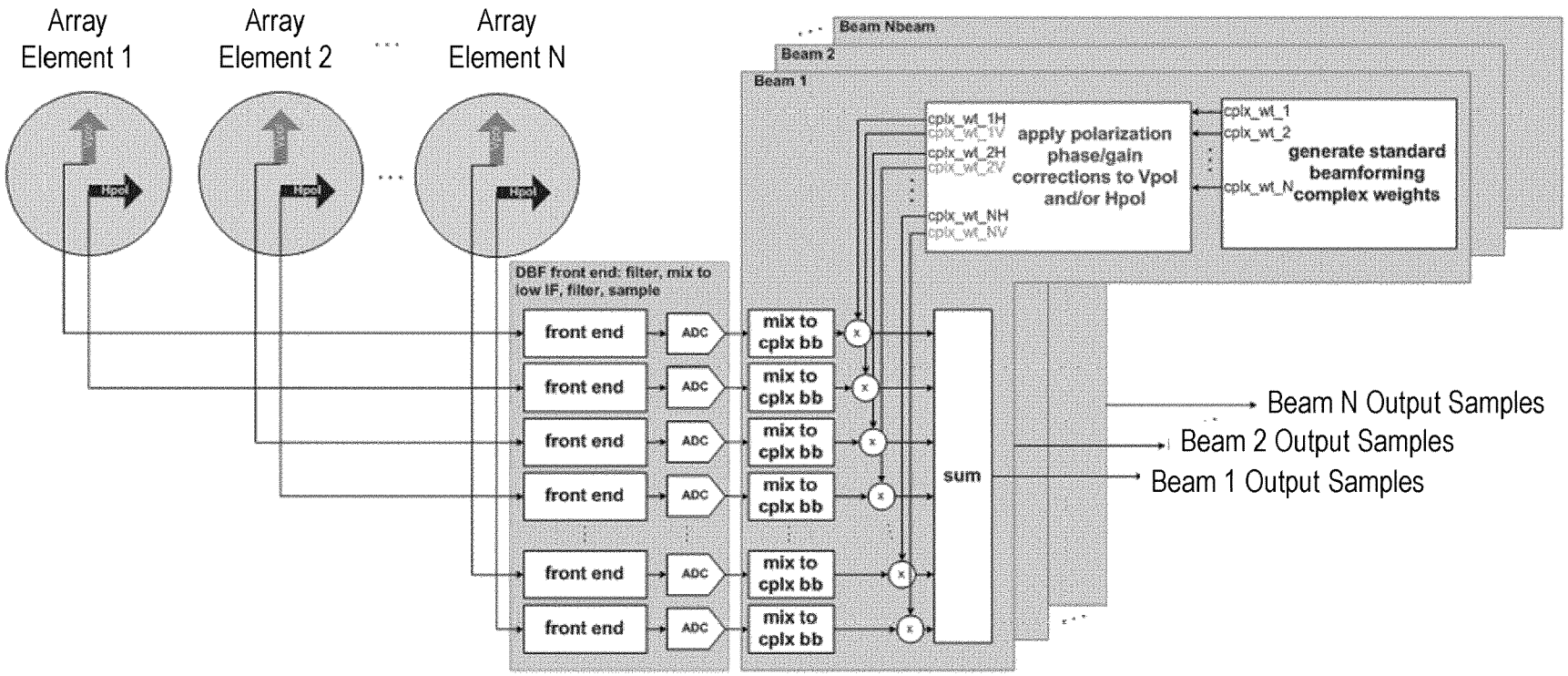
FIG. 4 shows a block diagram of a system for arbitrary polarization in beamforming for electronically scanned arrays in accordance with some embodiments of the inventive concepts disclosed herein.

Referring now to FIG. 4, depicted is one embodiment of a system 400 for arbitrary polarization in beamforming for electronically scanned arrays. In the system 400, each element of electronically scanned array (ESA) may have a horizontal polarization (Hpol) and a vertical polarizatoin (Vpol). Hpol may use only the front end chains connected to Hpol of the element, and the same for Vpol. Arbitrary linear polarization may be accomplished by applying different gain to the Hpol signals than to the Vpol signals, for example, equal weight would provide 45° linear polarization. Circular polarization may be achieved when the Hpol and Vpol signals are combined with a 90° offset on one of them (complex beam weights on Hpol or Vpol multiplied by +/−i). Changing right/left hand may result from either changing the sign of the rotation (+90° to −90°, or applying the rotation to the other polarization (e.g. Vpol rather than Hpol). Elliptical polarization may be the same as circular, but with a different magnitude on beam weights for Hpol versus Vpol.

With multiple independent beams, each beam may have a separate set of complex weights used to combine the signals. Each beam may incorporate polarization into its weights, allowing independent polarization control per beam. For example, a digital beamformer (DBF) such as provided by an ACT module may have multiple beams, or an analog beamformer (ABF) may have multiple beams with multiple phase/gain control devices per element/polarization. The ACT module can include a receiver DBF and a transmitter ABF. The hardware may also include dual polarization arrays (e.g., BAVA, TCDA, OneWeb, future WxR, Due Regard Radar, and X-Band SAR). Beam weights may be adjusted to handle arbitrary polarization. Each beam may have independent arbitrary polarization, and can be applied to single elements or sub-arrays. For example, DBF processing update may be used with standard DBF.

While polarization control exists for certain systems, this approach as laid out in the system 400 may include polarization control in the beam weights. The architecture of the system 400 may be able to see standard beamforming architecture to provide arbitrary polarization. Furthermore, the system 400 may be compatible with ABF, DBF architectures as well as with transmit or receive ESAs. The system 400 may provide arbitrary polarization per beam Given independent simultaneous beams (any combination of single element to full array). Furthermore, the system 400 may be useful for polarization compensation at extreme scan angles.

C. Ultra-Wide Band Active Electronically Scanned Arrays for Element-Level Synthesis Next generation integrated communication and navigation systems may have different system configurations. The communication systems may be spectrally agile, covert, A/J, reconfigurable, directional. The networks for the communication systems may be ad-hoc, self-forming, software-defined. Positioning, navigation and timing (PNT) systems may involve relative navigation links with 2-way time transfer for high anti-jam, high precision, and parent-to-swarming low-cost attributable children asset, among others. The systems may also involve UWB DF, ES, EA, Sigint/COMINT. The radar may also implemented using SAR, GMTI, D&A, and WxR. The change in systems may present certain challenges for contemporary UWB AESA technologies, such as: low profile, Ultra-Ultra-Wide Band (($U^2$WB), ≤10:1 instantaneous Bandwidth (IBW)); independently steered, multi-beam operation; meeting frequencies of interest; and wide-scan volume coverage (>±60° conical scan volume); and polarization diversity. There may be desire for a rapid, dynamic AESA polarization adjustment with polarization state change rates commensurate with AESA scan velocity profiles.

In addition, SIGINT Rx systems may entail polarization match any arbitrary signals, such as vertically polarization (VP), horizontal polarization (HP), slant linear (45° inclined linear), right or left hand circuit polarization (RHCP/LHCP), right or left hand elliptical polarization (RHEP/LHEP). Examples of polarization states may include: VP or HP for weather, GMTRI, SAR, Sense and Avoid Radar, commercial wireless, cellular, WiFi, Hotspot, LAN, and 5G, among others; VP in addition to HP for parametric, remote sensing radar, ELINT/SIGINT/COMINT and jammer systems, among others, CDL, commercial wireless, cellular, WiFi, Hotspot, RCHP or LCHP for LAN, and 5G applications; slant linear for ELINT/SIGINT/COMINT and jammer systems; SatCom, radar, GPS, GNSS, and Precision Navigation Timing (PNT) systems. For advanced systems, other examples may include: Frequency, polarization and beam UWB "hopping" radars; IoT, mobile hot spots, and 5G back haul; and bit based BSK/M-ary modulation, among others. Other applications may include SatCom connectivity, weather, High altitude engine icing (HAIC), runway imaging radar, directional data link, and wireless cabin connectivity, among others.

Next Generation SIRIGN Systems may optimally and agilely scan frequency, pointing angle and polarization states "on the fly", real time, within a given beam scan profile. System prerequisites may specify dynamic polarization states changes over UWB Instantaneous Bandwidths (IBW), e. g., 10:1, on the order of microseconds or less. The Axial Ratio (AR) of the standard polarization purity Figure of Merit (FOM) of Dual Orthogonal Linear (DOLP) AESAs typically may deteriorate as the beam is scanned off boresight. An extremely fast polarization state adjustment of the AESA as a function of beam scanning and frequency may thus be highly desirable. The ability to change polarization state faster than the AESA's beam scan rate may also be highly desirable.

Figure 5A:
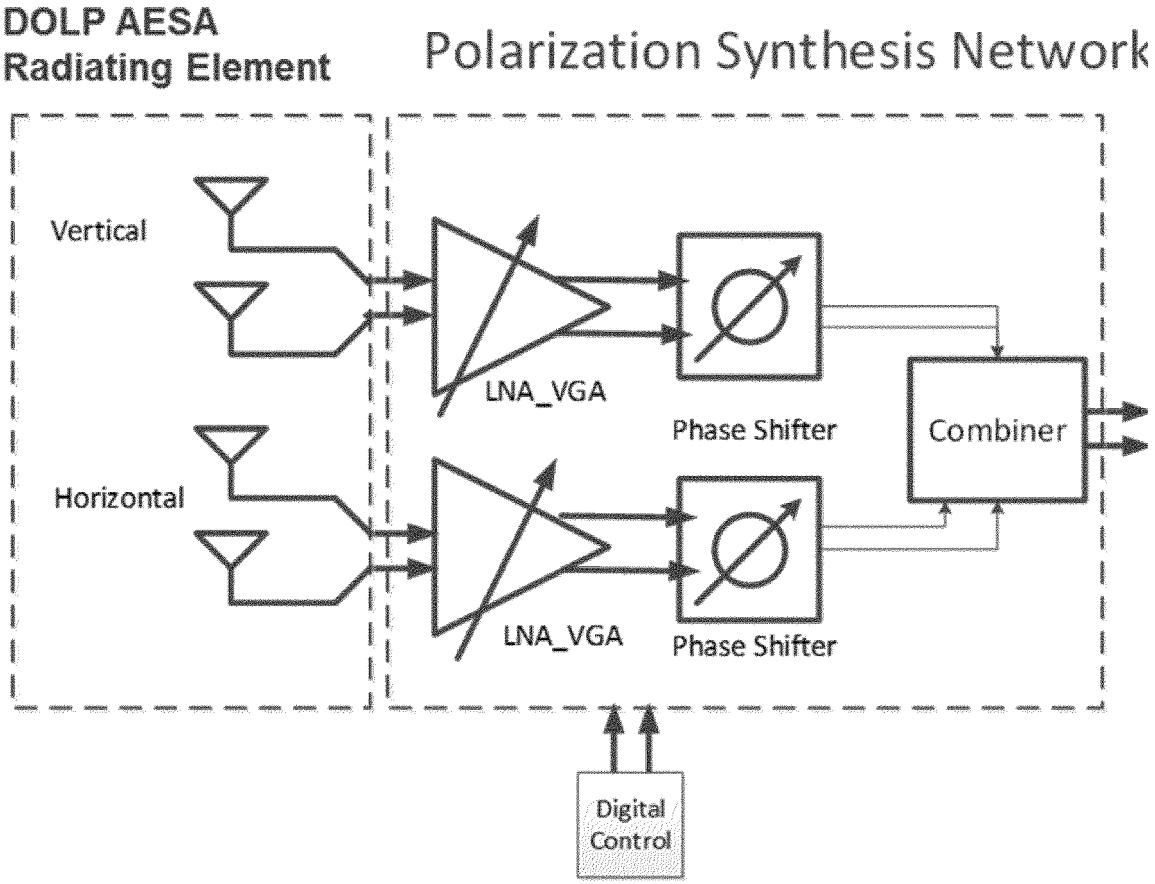
FIG. 5A shows a block diagram of system for ultra-wide band active electronically scanned arrays for element-level synthesis in accordance with some embodiments of the inventive concepts disclosed herein.

Referring now to FIG. 5A, depicted is one embodiment of a system 500 for ultra-wide band active electronically scanned arrays for element-level synthesis. To realize a polarization synthesis network (PSN) of the system 500 as based on miniature Radio Frequency Integrated Circuit (RFIC) technology, SiGe, RF CMOS and SOI technologies may be used. Such techniques provide high circuit density digital, analog, RF, microwave and mmWave circuits within a common, monolithic IC technology. Other technologies, such as III-V semiconductors may also be possible. The PSN described above may be incorporated at the element-level within the AESA architecture, in addition to the time delay (or phase shift) required to scan the AESA's beam. The above PSN is miniaturized through RFIC technology—to be size compatible (i.e. surface area) with the traditional λ/2 by λ/2 unit cell size (at the highest operating frequency) of the AESA lattice. The PSN can be a standalone RFIC integrated with required LNA, phase shifter/Time Delay, and transmitter exciter circuits, among others. RF sub-circuit portioning may typically be specific systems dependent.

Under system 500, broadband RHCP/LHCP may be set by channel amplitude balance and ±90° phase shift across the entire Instantaneous/Information Bandwidth (IBW) as well as Equi-phase & Equi-amplitude signal combing. The PSN may accepts VP and HP DOLP signals from AESA radiating element. The DOLP signal can either be differential (as shown) or single ended. VGA/LNA & phase shifters are may be DAC/ADC/SPI bus technologies. Phase shifter may set differential phase for desired polarization state. The VGA/LNA may predominately set system NF and may provide broadband amplitude balance for slant linear and RCCP/LHCP polarization states. The VGA/LNA may also provide design differential amplitude ratios for RHEP/LHEP. The two-channel solution may ensure precise adjustment of differential amplitude & phase to enable low AR circular polarization.

Figure 5B:
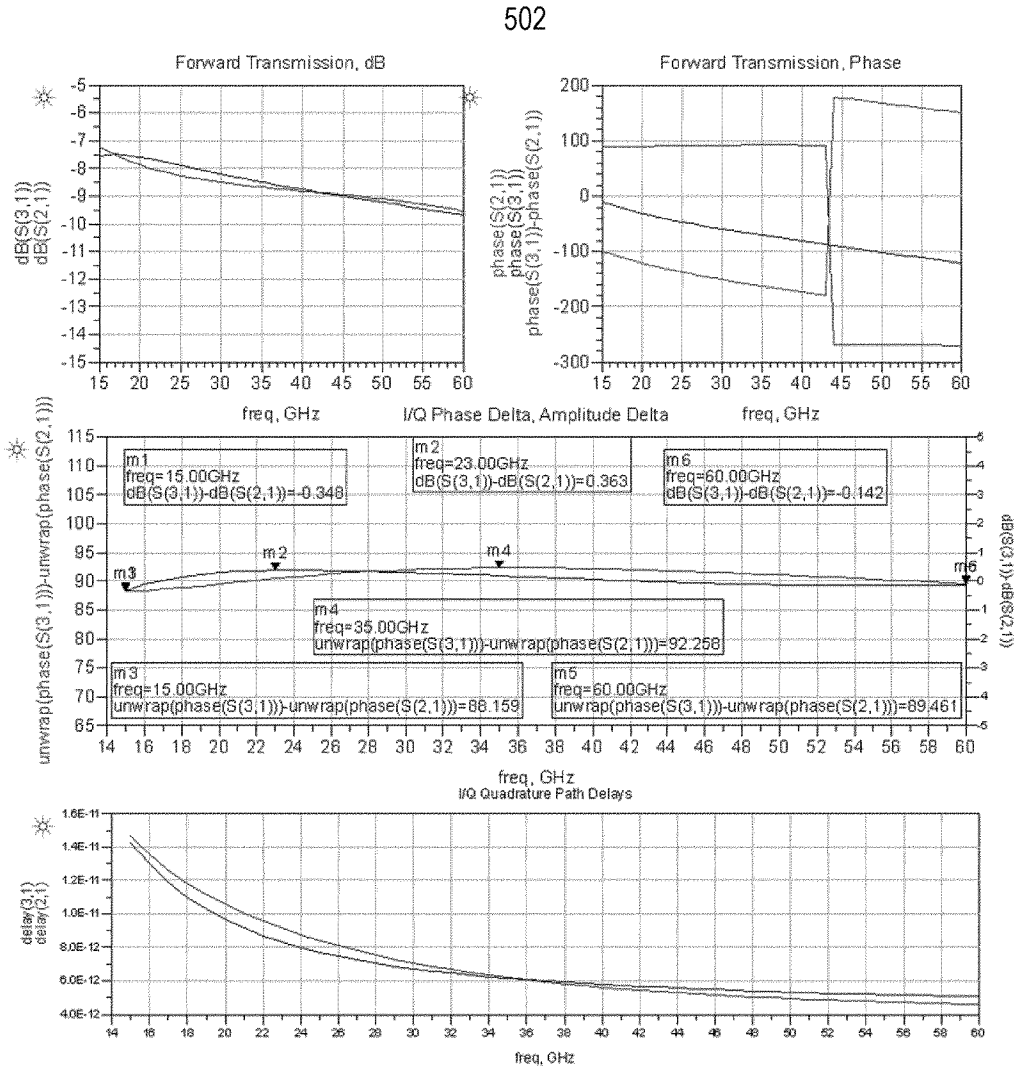
FIG. 5B shows a graph of various performance measures of the system for ultra-wide band active electronically scanned arrays for element-level synthesis in accordance with some embodiments of the inventive concepts disclosed herein.

As depicted in FIG. 5B, the-stage quadrature network within the Vector Modulator Phase Shifter (VMPS) may provide ±0.4 dB & ±2° phase variation for a 6 GHz IBW, and may equates to a ≤0.5 dB Axial Ratio, which is good CP polarizations purity, assuming a very intrinsic x-pol from the DLP radiating element. A measure of ±0.5 dB & ±3° Phase precision may be considered desirable. For comparison, Russ Wyse's 2-stage quadrature network may provide ±0.4 dB & ±2° phase variation for a 6 GHz IBW., ensuring quality RHCP.

Figure 6A:
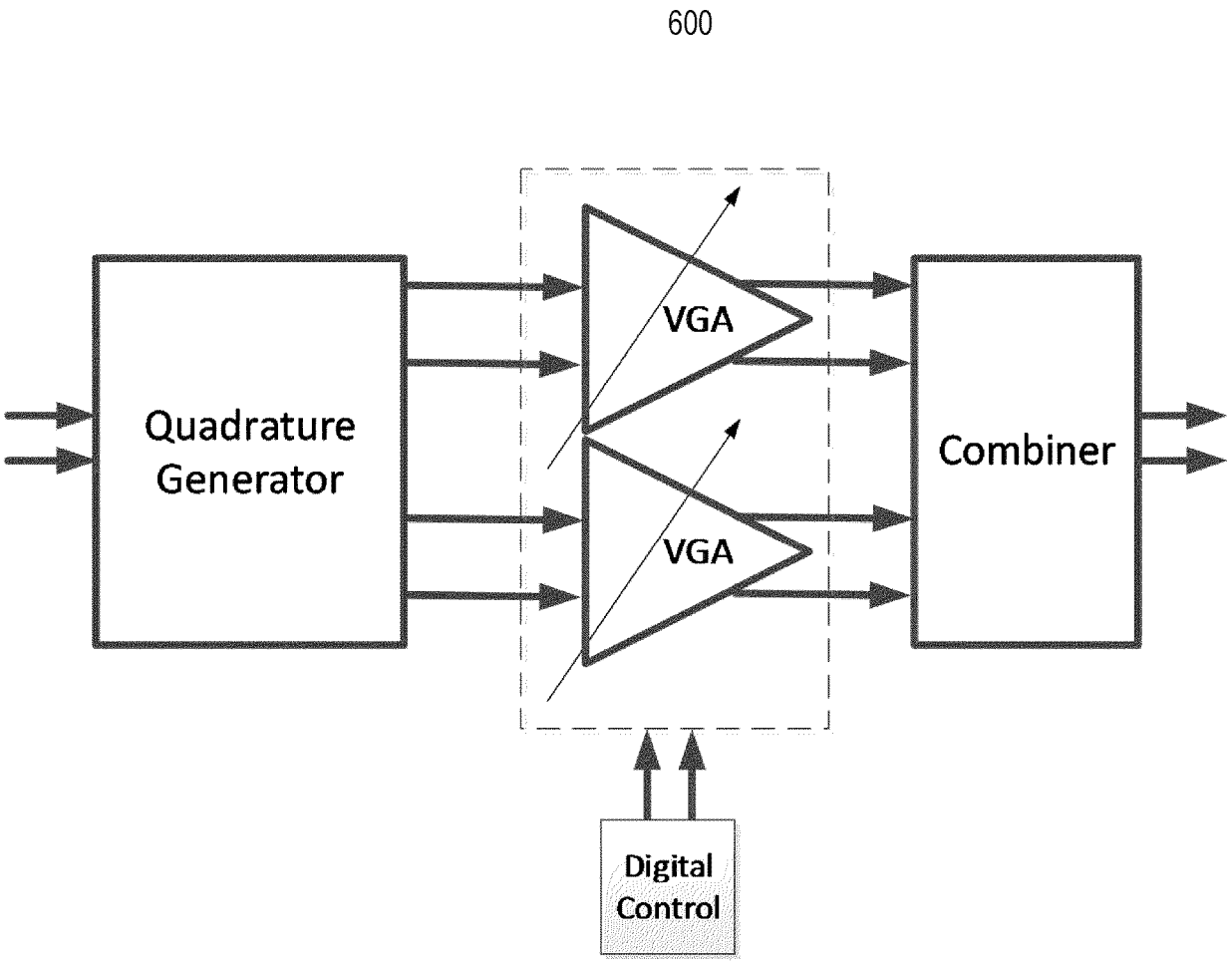
FIG. 6A shows a block diagram of a system for a vector modulator phase shifter in accordance with some embodiments of the inventive concepts disclosed herein.

Referring now to FIG. 6A, depicted is one embodiment of a system 600 for a vector modulator phase shifter. The following may be considerations in designing the system 600. The vector modulator phase shifter of system 600 may be extremely wide band (e.g., 10:1-ish for the flat phase). The active sections may be UWB and the quadrature generator may be the IBW limiter. Quadrature generator performance ultimately may set the IBW of the VMPS, which in turn may set the IBW of the PSN. Poly-phase passive QG may be lossy but may have excellent UWB phase quadrature performance. Poly phase QG blocks may be generally lossy and relatively narrowband. The wideband quadrature blocks may have both excellent UWB IBW for amplitude/phase balance.

Figure 6B:
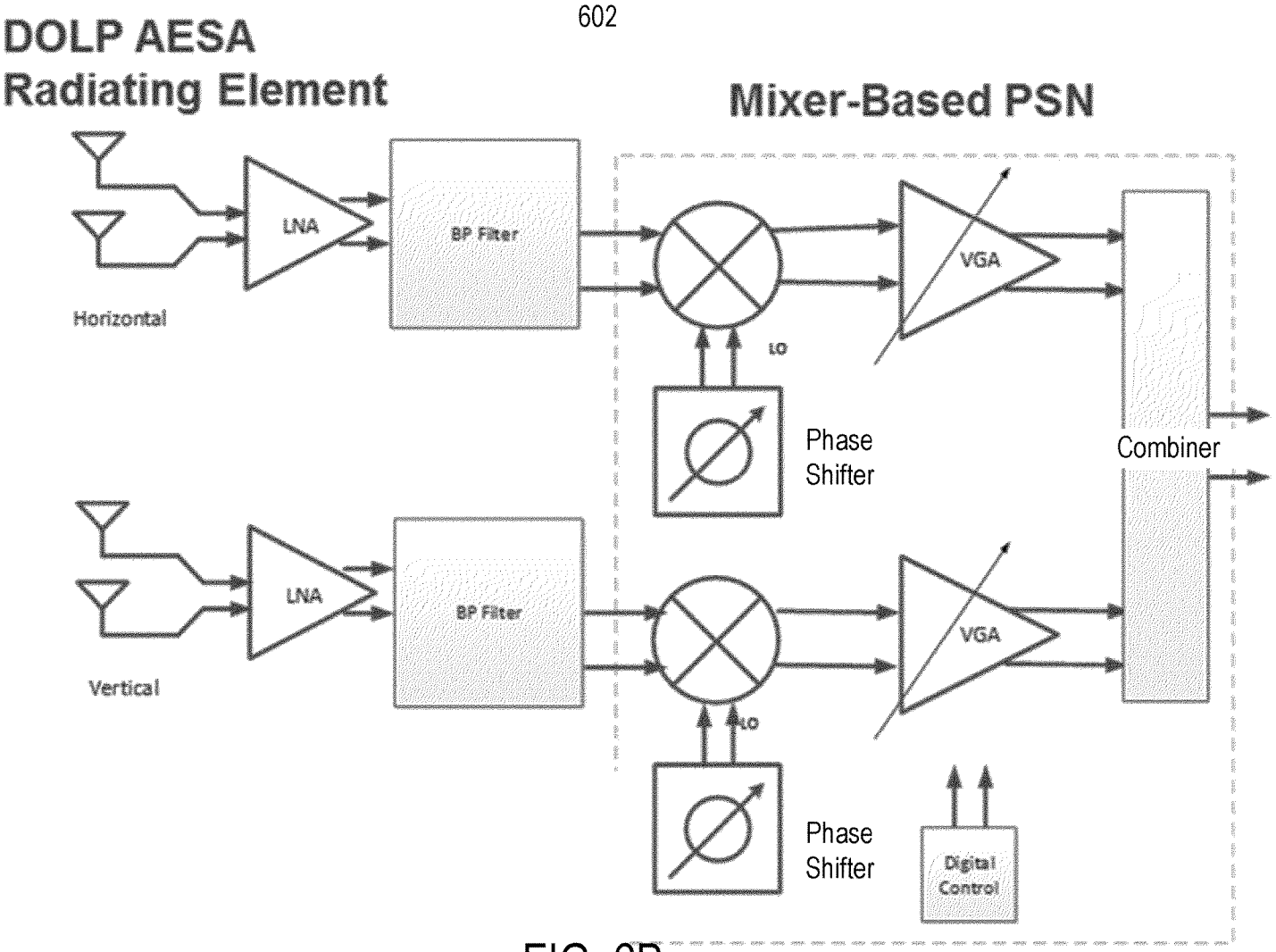
FIG. 6B shows a block diagram of a system for a mixed-based polarization synthesis network (PSN) topology in accordance with some embodiments of the inventive concepts disclosed herein.
Figure 6C:
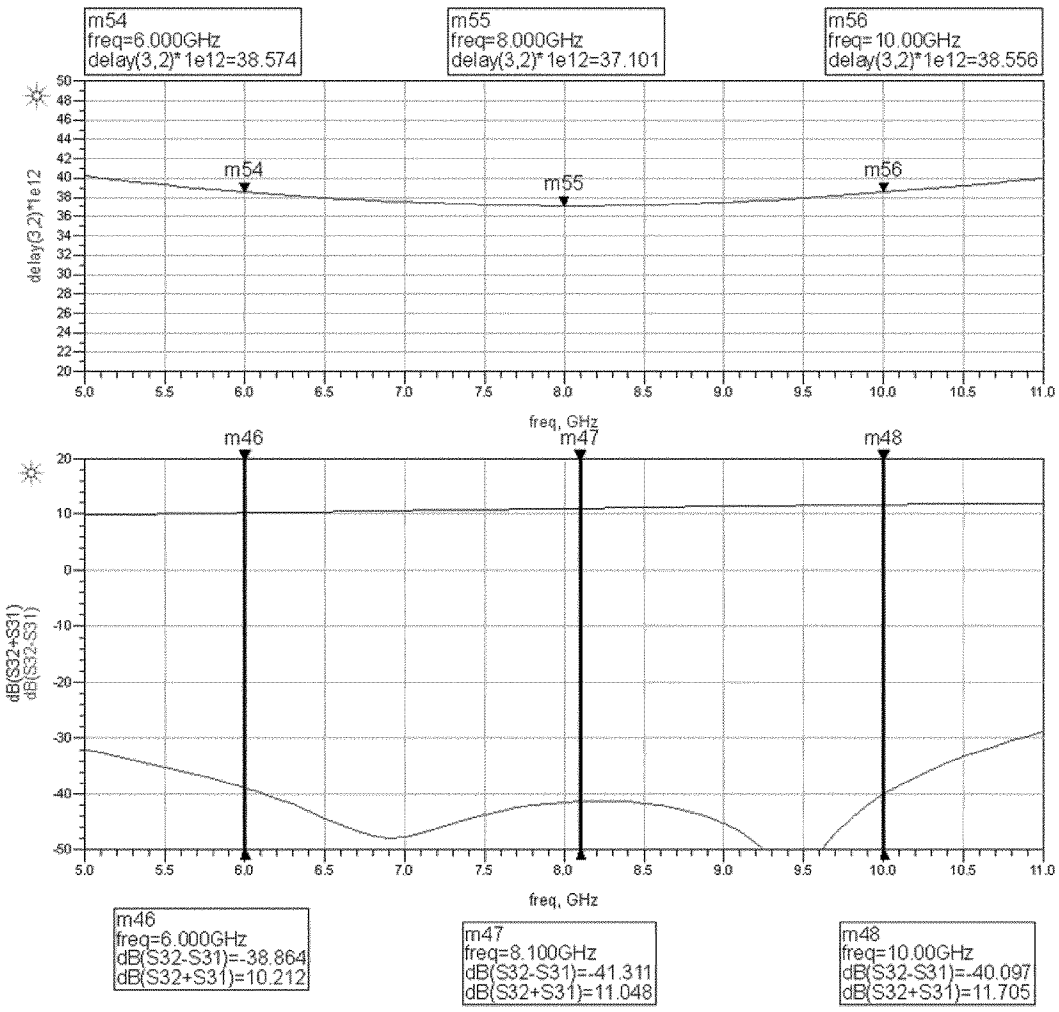
FIG. 6C shows a graph for performance of frequency quadrature alignment, in accordance with some embodiments of the inventive concepts disclosed herein.

Referring now to FIG. 6B, depicted is one embodiment of a system 602 for a mixed-based PSN topology. In system 602, phase and amplitude channel balance may be created at IF rather than RF. The phase shifted LOs may produce phase shift at IF. The phase shifters on both channel may ensure UWB differential phase balance at IF. The IF IQ for the VMPS may have much less layout parasitic sensitivities and lower loss. Performing IQ alignment at IF may greatly simplify calibration across the very large (UWB) RF bandwidth. The system 602 can also be used in the new ultra-wideband image flexible rejection filtering techniques (high side, low side or both side selectable, and tunable bandwidth to allow increasing sensitivity over narrower IBW). This filtering method may not disturb delay in comparison to conventional filters. The system 602 may "self-heal" the passive quadrature block component value imperfections due to statistical tolerance or temp variations by calibrating the LO phase shifter and IF/RF amplitude balance. Referring now to FIG. 6C, shown is a graph 604 for performance of frequency quadrature alignment. The graph 604 may depict the ability to alter time delay versus frequency variation from the passive IF FQ network. The IF FQ combiner block can be made to have very good time delay variation across a larger (4GH) IBW, still allowing for low broadband phase/amplitude error (<+/−0.3 deg and <+/−0.05 dB).

In conventional techniques, one standard solution may be to create a slant linear polarization to receive/transmit all polarizations, but with SNR degradation as a function of polarization state. The SLAT linear may have a 3 dB 1-way loss to CP, and complete cross polarization cancellation occurs for Dual Orthogonal Slant Linear polarization. However, this technique may not have the ability to discriminate polarization sense, e.g., RHCP/RHCP. In addition, some AESAs may be implemented as element level dual-channel implementation, e.g. a VP manifold and an HP manifold, with PSN performed post-combining/pre-splitter of the RF signal. However, this may create 2× interconnect density with the AESA feed manifold which is unnecessarily complex, costly and limited the upper operating frequency of the AESA. Non-AESA, systems analog RF may incorporate PSNs at the main VP & HP I/O ports. However, such systems may be narrow-band, not ultra-wideband.

To realize an intra-AESA lattice PSN as based on miniature RFIC technology, the above PSN may be miniaturized through RFIC technology to be size compatible (i.e. surface area) with the traditional λ/2 by λ/2 unit cell size (at the highest operating frequency) of the AESA lattice. The PSN may be incorporated/integrated at the element-level within the AESA architecture, in addition to the time delay (or phase shift) required to scan the AESA's beam. The PSN can be a standalone RFIC integrated with required LNA, phase shifter/Tide Delay, and transmitter exciter circuits, among others. RF subcircuit portioning may be typically specific systems dependent. The PSN can be uni-channel for dual VP/HP UWB AESA systems at the pre-splitter (Tx mode) or post combiner (Rx) Analog RF ports. The PSN can also be used for non-ESA, motor-scanned directional antenna systems, e.g., motor driven reflector systems. The PSN can also be used for UWB omnidirectional, polarization diverse systems as well.

Figure 7:
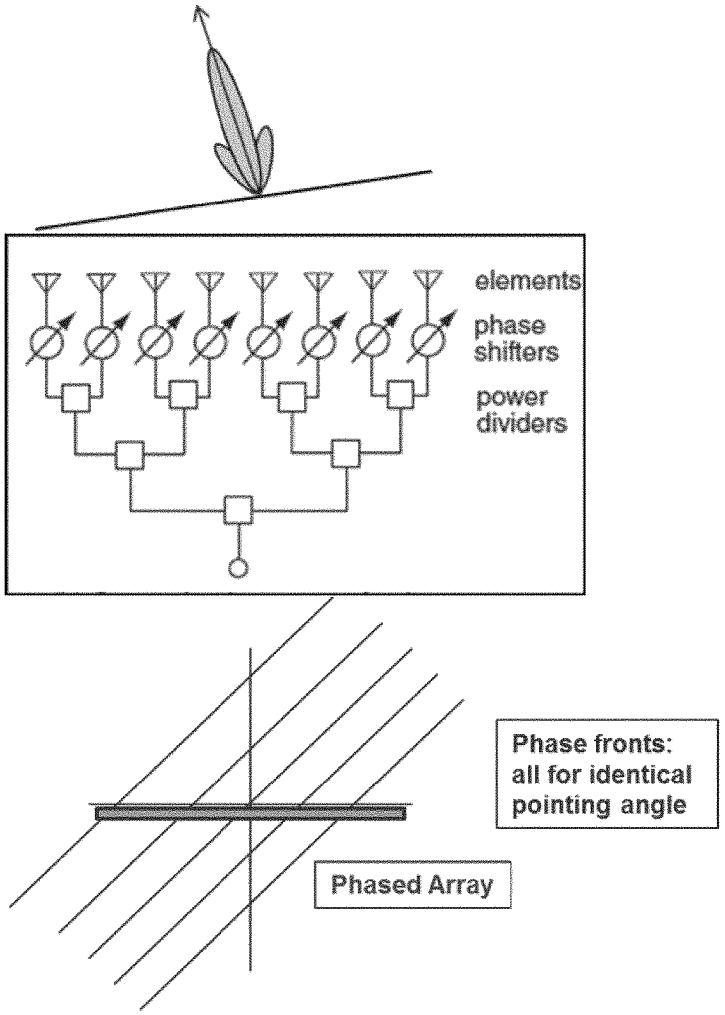
FIG. 7 shows a block diagram of a system for beam steering with ultra-wideband active electronically scanned array elements, in accordance with some embodiments of the inventive concepts disclosed herein.
Figure 7:
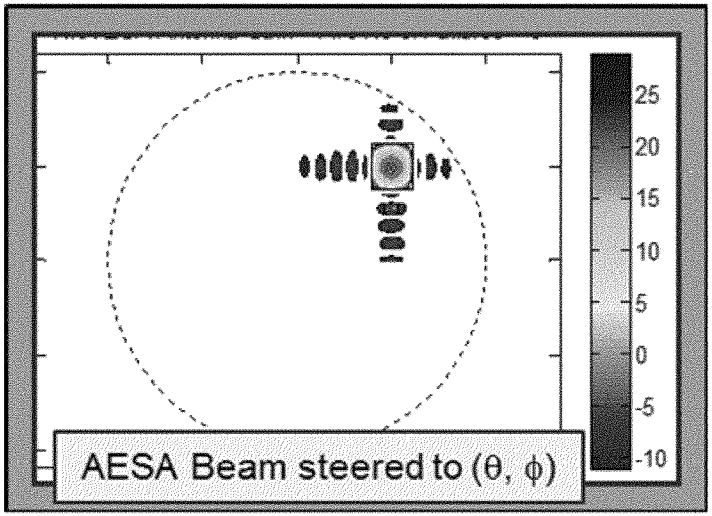

Referring now to FIG. 7, depicted is one embodiment of a system 700 for beam steering with ultra-wideband active electronically scanned array elements. The superposition of the element-to-element phase for beam steering into the PSN without any increase of circuitry for and SWAP-C optimized solution may be realized using an integrated PSN/Beamformer (PSNBF). The PSNBF may be miniaturized through RFIC technology to be size compatible (i.e. surface area) with the traditional λ/2 by λ/2 unit cell size (at the highest operating frequency) of the AESA lattice. The PSNBF can be a standalone RFIC integrated with required LNA, phase shifter/Time Delay, and transmitter exciter circuits, among others. RF sub-circuit portioning may be typically specific systems dependent.

In system 700, differential phase shift between adjacent elements may determine the ESA beam steering pointing angle. Phase shifters may operate modulo−360°, such that less than 360° phase is wrapped to modulo−360°. Negative phase may be possible (e.g., −90°=)+270°. Absolute phase reference may be arbitrary. Broadband RHCP/LHCP may be set by channel amplitude balance and ±90° phase shift across the entire Instantaneous/Information Bandwidth (IBW) and Equi-phase and Equi-amplitude signal combing. PSN may set intra-dual linear polarized element polarization state. PSN may simultaneously set inter-element differential for AESA beam steering. UWB Polarization synthesis may involve flat differential phase over the instantaneous bandwidth. Beam steering may be to the correct inter-element differential phase shift over a squint-free instantaneous bandwidth. The PSN phase shifters may have agility and simultaneously adjust, as a function of beam steering and frequency.

Figure 8A:
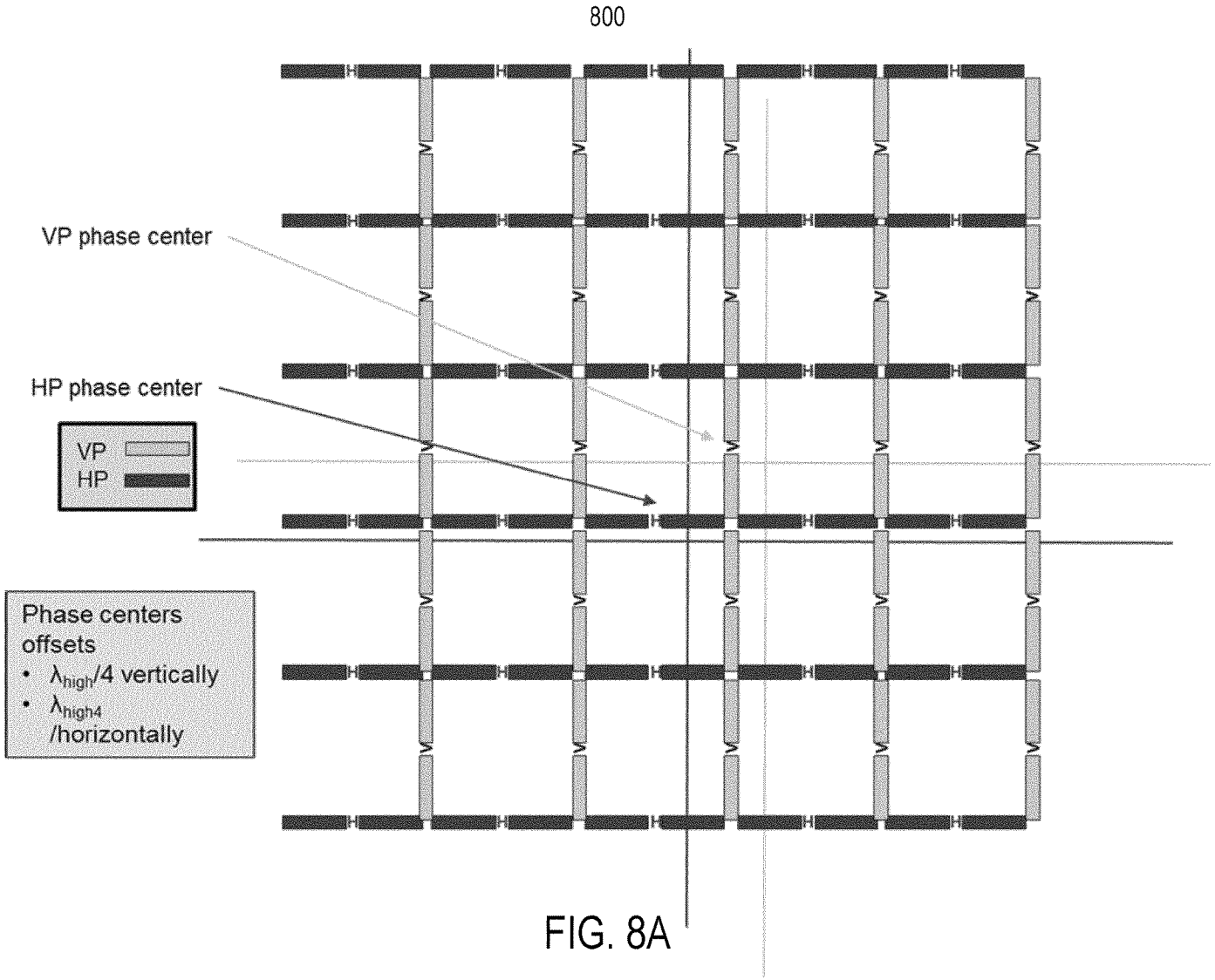
FIGS. 8A and 8B show a block diagram of a system for radiating non-coincident phase centers with ultra-wideband active electronically scanned array elements, in accordance with some embodiments of the inventive concepts disclosed herein.

Referring now to FIG. 8A, depicted is a system 800 for radiating non-coincident phase centers with ultra-wideband active electronically scanned array elements. A Coincident Phase Center Radiation Element AESA can correspond to a superposition of a VP array with an HP array, both with identical phase centers. Examples of coincident phase center radiation elements may include crossed dipoles, crossed droopy dipoles, planar crossed bow ties, spirals/sinuous/conical spirals, and certain classes of Vivaldi types. Issues with coincident phase centers may include Parasitic coupling between VP & HP components, higher order mode parasitic generation, challenges in extracting separate VP & VP signal, poor cross polarization isolation, and complicated hardware implementation of feed structures particularly at millimeter wave frequencies. It may be desired to generate low AR CP within an ASA that utilizes non-phase center coincident radiating elements with increased performance with commensurate reduction of hardware implementation complexity and parasitic mode suppression. To address these technical challenges, the system 800 may re-align the phase centers of two superimposed VP & HP arrays by time delay analog signal processing at the AESA unit cell level and by using the element-level polarization discrimination network.

Figure 8B:
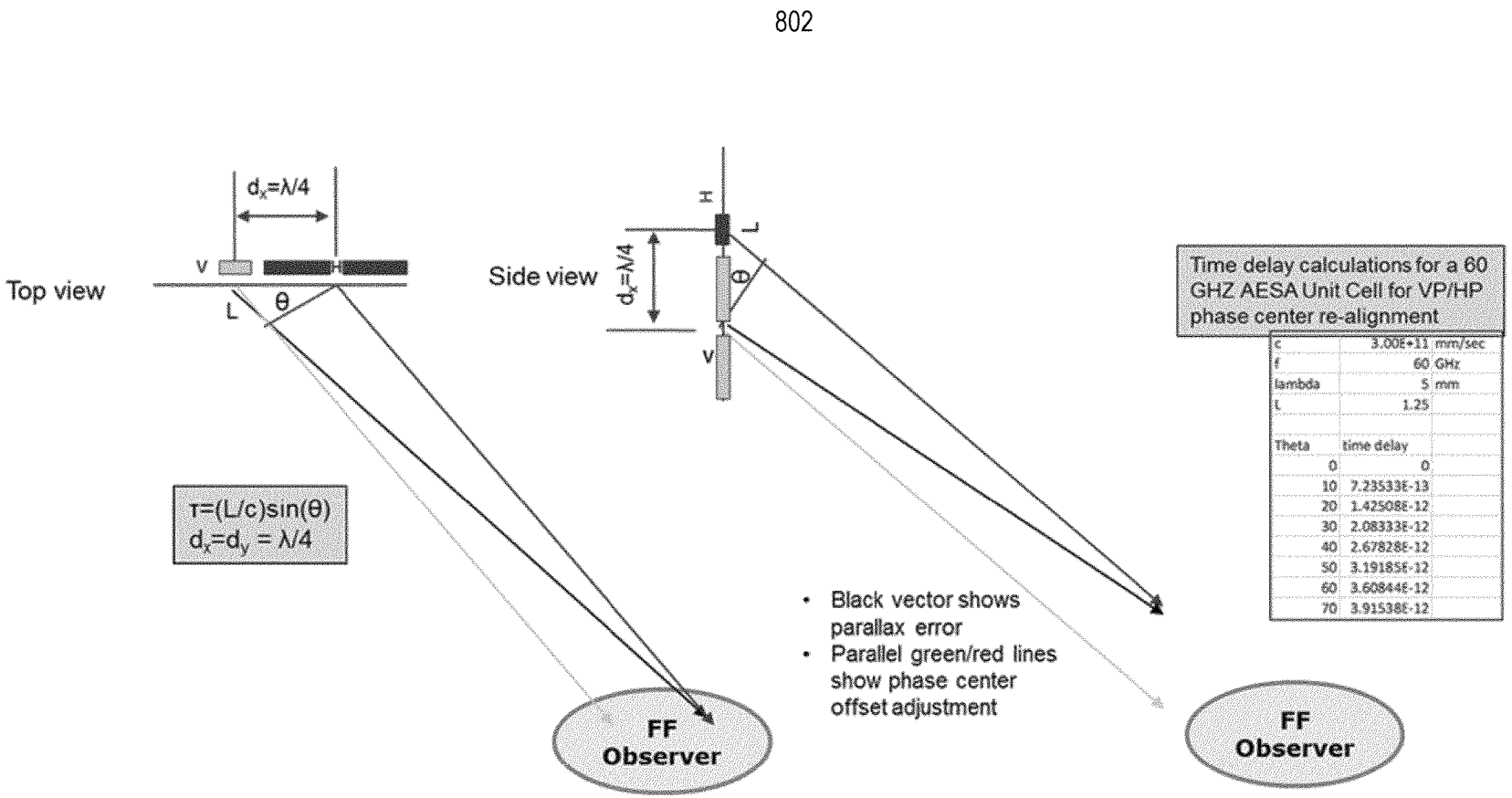

Referring now to FIG. 8B, depicted is a system 802 for radiating non-coincident phase centers with ultra-wideband active electronically scanned array elements. Non-phase center coincident (NCPS) VP and HP phase centers may be off set λ/4 vertically and λ/4 horizontally. Unit cell time delay may be used to re-align the radiating element phase centers. The system 802 can align VP phase center with HP phase center, and vice-versa. The system 802 can align both VP and HP phase centers to a new, common location. Parallelizing the red and blue vectors from the far field (FF) observation point may be equivalent to shifting the AESA's VP and HP coordinate system's origin to be identical via the principal of reciprocity. The required time delay calculation may be based on modelling NCPC unit cell as a two-element AESA. In addition, the time delay required for VP& HP alignment may be small since the two element AESA spacing is λ/4 vertically and λ/4 horizontally. The polarization alignment time delay may be superimposed on the time delay required for UWB squint/dispersion-free AESA beam steering. The example calculations illustrates that 4 ps of delay is required for a λ/2 sampled array lattice (i.e. grating lobe free) AESA operating at 60 GHz.

Minimal signal distortion may occur since the small time delay required is a small percentage of a complete carrier frequency period (e.g., one period at 60 GHz=16.7 ps). 3.92 ps may be used re-align the 60 GHz VP and HP offset phase centers in this specific example (3.92 ps/16.7 ps=24% of one period of 60 GHz signal for a 70° AESA beam scan off bore sight and less at shallower pointing angles). This relatively carrier alignment may be utilized as an offset to the nominal Modulo−360° phase commands used for beam steering. Alternatively, with more optimal distortion within the information bandwidth, TD circuits can be integrated within the PCN to realign the VP & HP phase centers. In many cases the PSN can accommodate non-coincident phase center radiating elements to synthesize low AR circular polarization. If ultimate distortion free performance is used, then the PSN can be embellished to include TD sub-circuits for VP/HP phase center realignment. With the PSN architecture, VP/HP phase center alignment time delay may be realized with additional time delay circuits, either analog or a digital implementation with a sufficiently small LSB for adequate distortion-free AESA performance.

In this manner, correction of axial ratio corruption, as a function of scan, of circularly polarized waves synthesized by an AESA may be comprised of radiating non-coincident phase center radiating elements. The system 802 may enable the use of non-coincident phase center radiating elements for circularly polarized AESAs (while preserving low AR, etc.) to solve other element design issues, such as parasitic modes, etc., that are associated with coincident phase center AESA radiating elements. These phase center realignments and signal processing scheme can also be implement via digital signal processing (DSBSP)/Digital Beam Forming (DBF) signal processing. The architecture may simultaneously incorporate beam steering inter-element phase differential with intra-element differential polarization synthesis with the PSB module as described, thereby improving SWAP-C through reduced DC power consumption. The system 802 may dynamically adjust for polarizations state and beam steering as a function of frequency and beam scanning. The system 802 may realize an intra-AESA lattice PSN as based on in miniature RFIC technology. The PSN may be incorporated or integrated at the element-level within the AESA architecture, in addition to the time delay (or phase shift) required to scan the AESA's beam.

The construction and arrangement of the systems and methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations). For example, the position of elements may be reversed or otherwise varied and the nature or number of discrete elements or positions may be altered or varied. Accordingly, all such modifications are intended to be included within the scope of the inventive concepts disclosed herein. The order or sequence of any operational flow or method operations may be varied or re-sequenced according to alternative embodiments. Other substitutions, modifications, changes, and omissions may be made in the design, operating conditions and arrangement of the exemplary embodiments without departing from the broad scope of the inventive concepts disclosed herein.

The inventive concepts disclosed herein contemplate methods, systems and program products on any machine-readable media for accomplishing various operations. Embodiments of the inventive concepts disclosed herein may be implemented using existing computer operational flows, or by a special purpose computer operational flows for an appropriate system, incorporated for this or another purpose, or by a hardwired system. Embodiments within the scope of the inventive concepts disclosed herein include program products comprising machine-readable media for carrying or having machine-executable instructions or data structures stored thereon. Such machine-readable media can be any available media that can be accessed by a special purpose computer or other machine with an operational flow. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with an operational flow. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions include, for example, instructions and data which cause a special purpose computer, or special purpose operational flowing machines to perform a certain function or group of functions.

What is claimed is:

1. A method for controlling signal polarization, comprising:

identifying a target polarization state for an antenna array, the target polarization state comprising a target amplitude and a target polarization angle, the antenna array comprising a plurality of antenna elements each communicatively connected to a variable gain amplifier (VGA) with discrete amplitude control, and a phase shifter with discrete phase control, to provide a plurality of discrete polarization states;

identifying a first polarization state and a second polarization state from the plurality of discrete polarization states, that are nearest in absolute amplitude to the target amplitude, and nearest in polarization angle to the target polarization angle, the first polarization state having a first polarization angle greater than the target polarization angle, the second polarization state having a second polarization angle less than the target polarization angle; and concurrently forming a signal with the identified first polarization state using a first portion of the plurality of antenna elements, and a signal with the identified second polarization state using a second portion of the plurality of antenna elements.

2. The method of claim 1, comprising performing a dot product of the target polarization state and the first polarization state to obtain a magnitude value.

3. The method of claim 2, comprising obtaining a ratio of the magnitude value to the target amplitude.

4. The method of claim 3, comprising determining the first portion of the plurality of antenna elements according to the ratio.

5. The method of claim 1, comprising:

performing a dot product of the target polarization state and the second polarization state to obtain a magnitude value;

obtaining a ratio of the magnitude value to the target amplitude; and determining the second portion of the plurality of antenna elements according to the ratio.

6. The method of claim 1, comprising approximately providing the target polarization state by spatially adding the signal with the identified first polarization state, to the signal with the identified second polarization state.

7. The method of claim 1, comprising selecting antenna elements for the first portion of the plurality of antenna elements, to be at least partly spatially interspersed with antenna elements for the second portion of the plurality of antenna elements.

8. The method of claim 1, comprising randomly selecting antenna elements for the first portion of the plurality of antenna elements, and antenna elements for the second portion of the plurality of antenna elements.

9. The method of claim 1, wherein the target polarization state, the first polarization state and the second polarization state are each a linear polarization state.

10. The method of claim 1, wherein the target polarization state, the first polarization state and the second polarization state are each a circular or elliptical polarization state.

11. A system for controlling signal polarization, the system comprising:

an antenna array comprising a plurality of antenna elements each communicatively connected to a variable gain amplifier (VGA) with discrete amplitude control, and a phase shifter with discrete phase control, to provide a plurality of discrete polarization states; and a polarization controller configured to:

identify a target polarization state for the antenna array, the target polarization state comprising a target amplitude and a target polarization angle;

identify a first polarization state and a second polarization state from the plurality of discrete polarization states, that are nearest in absolute amplitude to the target amplitude, and nearest in polarization angle to the target polarization angle, the first polarization state having a first polarization angle greater than the target polarization angle, the second polarization state having a second polarization angle less than the target polarization angle; and concurrently form a signal with the identified first polarization state using a first portion of the plurality of antenna elements, and a signal with the identified second polarization state using a second portion of the plurality of antenna elements.

12. The system of claim 11, wherein the polarization controller is further configured to perform a dot product of the target polarization state and the first polarization state to obtain a magnitude value.

13. The system of claim 12, wherein the polarization controller is further configured to obtain a ratio of the magnitude value to the target amplitude.

14. The system of claim 13, wherein the polarization controller is further configured to determine the first portion of the plurality of antenna elements according to the ratio.

15. The system of claim 11, wherein the polarization controller is further configured to:

perform a dot product of the target polarization state and the second polarization state to obtain a magnitude value;

obtain a ratio of the magnitude value to the target amplitude; and determine the second portion of the plurality of antenna elements according to the ratio.

16. The system of claim 11, wherein the polarization controller is further configured to approximately provide the target polarization state by spatially adding the signal with the identified first polarization state, to the signal with the identified second polarization state.

17. The system of claim 11, wherein the polarization controller is further configured to select antenna elements for the first portion of the plurality of antenna elements, to be at least partly spatially interspersed with antenna elements for the second portion of the plurality of antenna elements.

18. The system of claim 11, wherein the polarization controller is further configured to randomly select antenna elements for the first portion of the plurality of antenna elements, and antenna elements for the second portion of the plurality of antenna elements.

19. The system of claim 11, wherein the target polarization state, the first polarization state and the second polarization state are each a linear polarization state.

20. The system of claim 11, wherein the target polarization state, the first polarization state and the second polarization state are each a circular or elliptical polarization state.

* * * * *